United States Patent [19]

Horton

[11] 4,284,121

[45] Aug. 18, 1981

[54] PROCESS AND MATERIALS FOR MAKING REFRACTORY CORES

[75] Inventor: Robert A. Horton, Chesterland, Ohio

[73] Assignee: Precision Metalsmiths, Inc., Cleveland, Ohio

[21] Appl. No.: 125,468

[22] Filed: Feb. 28, 1980

[51] Int. Cl.[3] ..... B22C 1/02

[52] U.S. Cl. ..... 164/520; 164/132; 164/526; 106/38.3; 106/38.35

[58] Field of Search ..... 164/41, 43, 28, 138, 164/131, 132, 15; 106/38.35, 38.3

[56] References Cited

U.S. PATENT DOCUMENTS

| | | | |
|---|---|---|---|
| 3,686,006 | 8/1972 | Horton | 106/38.3 |
| 3,769,044 | 10/1973 | Horton | 106/38.3 |
| 3,859,405 | 1/1975 | Horton | 106/38.35 X |
| 4,064,083 | 12/1977 | Horton et al. | 106/38.7 X |

*Primary Examiner*—Robert D. Baldwin
*Assistant Examiner*—K. Y. Lin
*Attorney, Agent, or Firm*—Watts, Hoffmann, Fisher & Heinke Co.

[57] ABSTRACT

Ceramic cores suitable for use in investment casting operations are molded from a mixture containing comminuted refractory which includes partially dehydrated gypsum and a sublimable binder. When the sublimable binder has been sublimated from the molded core, it is soaked in water in order to hydrate the gypsum and cause it to set.

6 Claims, No Drawings

PROCESS AND MATERIALS FOR MAKING REFRACTORY CORES

DESCRIPTION

1. Technical Field

The present invention relates generally to the manufacture of molded refractory articles, and more specifically to compositions and methods for making refractory cores that are useful in metal casting processes, especially investment casting.

2. Background Art

Preformed ceramic cores are used in investment casting processes, and to a lesser extent in other metal casting processes, to form holes, slots, etc. in the castings. In the case of investment casting procedures, the core can be positioned in the pattern material injection die and molten wax or other lost pattern material injected around the core to form the pattern. It is also a practice to make the patterns and cores separately and insert the cores into openings in the patterns. In either case, the cores become incorporated into the investment molds when they are formed around the patterns. The core is made to extend beyond the pattern at one or more locations and becomes embedded in the mold at these locations so that it is firmly held in position when the pattern is melted out of the mold. In other casting procedures, preformed ceramic cores are assembled directly into the molds, for example, molds of the cope and drag type, which are provided with suitable core prints in which the cores are seated.

A conventional composition that has been used in the past to make molded ceramic cores consists essentially of comminuted refractory material, a sublimable organic binder having a high solid state vapor pressure, e.g. napthalene and paradichlorobenzene, and a small amount of a non-sublimable binder. This composition can be injection molded into the desired shape. The sublimable binder is sublimated after molding and the molded shape is then fired to sinter it. The non-sublimable binder in the composition is intended to improve green strength so that the molded articles can be handled without damage prior to sintering.

The practice of firing ceramic cores at high temperatures in order to sinter the refractory material and develop a ceramic bond is undesirable for a number of reasons. It causes sintering shrinkage which makes it difficult to control dimensions and prevent warpage. It also reduces the porosity of the cores so that they are not readily permeable to the hot mold gasses. This can result in gas entrapment in the castings.

High temperature sintering of refractory cores produces excessive strength which is usually undesirable during the casting operation. Excessive strength of the cores can cause hot tearing of the metal castings during solidification and can make it difficult to remove the cores from the castings. For example, when employing conventional, sintered ceramic cores, it may be necessary to subject the castings to harsh chemicals, such as aqueous or molten sodium or potassium hydroxide, hydroflouric acid, etc. in order to remove the cores from the castings. These chemicals are corrosive to many alloys, especially aluminum and other non-ferrous alloys, and present serious problems connected with the handling and disposing of the toxic materials.

The conventional practice of firing cores to sinter the refractory requires special equipment, materials, and operations that have contributed to the cost of core production. For example, high temperature furnaces are required for the sintering operation. In addition, it is customary to provide refractory saggers in which the cores are fired. Other conventional expedients include embedding the cores in granular refractory particles or providing individual refractory forms contoured to the shape of the cores in order to support them during firing.

U.S. Pat. No. 3,686,006 discloses an improved practice that eliminates the need for firing and sintering ceramic cores prior to use. In accordance with the improved practice disclosed in that patent, the sublimable binder is first sublimated from the unfired cores to provide a porous structure and the cores are then strengthened by impregnating their pore structure with an impregnating agent consisting essentially of a refractory binder in a carrier liquid and which is capable of being hardened to form a continuous bonding structure. In one disclosed embodiment, the impregnating agent is a colloidal dispersion of inorganic material, such as silica.

DISCLOSURE OF INVENTION

The present invention provides a new process of making refractory cores and other articles that eliminates the need for firing the cores prior to use and/or impregnating them with a hardening agent such as colloidal silica, as disclosed in U.S. Pat. No. 3,686,006. Cores made according to the invention have the strength necessary to resist breakage and damage during handling and the operation of injecting pattern material around the cores. At the same time, the cores are soft enough that they can be easily removed from the castings without resorting to chemical treatment or other special cleaning operations. The methods and compositions of the invention are especially suited for making preformed ceramic cores that can be used in casting low melting, non-ferrous metals and alloys such as the aluminum, magnesium, and copper-based alloys, and the like.

The invention provides an improved process of making molded refractory articles, such as preformed ceramic cores, from a mixture containing comminuted refractory material and a sublimable binder that is sublimated after molding to provide a porous structure, characterized by the novel steps of compounding the mixture to include partially dehydrated gypsum as part of the refractory material, soaking the molded article in water after the sublimable binder has been sublimated, and allowing the water in the pores of the molded article to hydrate the gypsum and cause it to set. A more specific embodiment of the new process comprises the steps of: (a) preparing a mixture of refractory material, a sublimable binder and a non-sublimable binder, the refractory material including partially dehydrated gypsum in the alpha form; (b) molding the mixture into the desired shape; (c) sublimating the sublimable binder from the molded shape to provide a porous structure; (d) soaking the molded shape in water to saturate its pores; (e) removing the molded shape from the water, and (f) allowing the water in the pores to hydrate the gypsum and cause it to set.

The invention also provides a composition for making molded refractory articles such as preformed ceramic cores containing comminuted refractory and a sublimable binder capable of being sublimated after molding to provide a porous structure, characterized in that the comminuted refractory includes partially dehydrated gypsum. In the preferred embodiments, the gypsum is calcium sulfate hemihydrate and is present in an amount of 20 to 50% by weight based on the weight of the refractory component of the mixture.

Calcium sulfate hemihydrate is prepared in various forms from the mineral gypsum, i.e., calcium sulfate dihydrate ($CaSO_42H_2O$). One form is known as alpha calcium sulfate hemihydrate and is characterized by uniform, relatively dense crystals. These properties contribute to high strength after setting. A second form is prepared by heating the dihydrate in a boiling solution of calcium chloride and is characterized by a still denser crystal structure. The crystals are better developed, show a cubic or rectangular shape, and display less cracking and porosity. Both crystalline forms are preferred for purposes of this invention and are intended to be encompassed by the term "alpha" calcium sulfate hemihydrate. A third variety commonly referred to as plaster of Paris is beta calcium sulfate hemihydrate. This form is satisfactory for use in the invention, but is less preferred than the "alpha" form because the crystals are irregularly shaped and are more porous.

The cores can be produced quickly and economically by injection molding on standard plastic injection molding equipment. After the gypsum in the cores has been hydrated and set, the cores are ready for immediate use. They can be placed in a pattern injection die and molten pattern material, such as wax, injected around them. Alternatively, the cores can be inserted into suitable openings of separately formed patterns made of wax or the like.

In investment casting operations, the molds are formed around the patterns and their cores in the usual manner. These can be either bulk investment molds or ceramic shell type molds. The patterns are then removed from the molds in a conventional manner, as by heating in an autoclave or in a low temperature oven. When the pattern removal operation has been completed, the investment molds are typically fired to temperatures ranging from about 1000° F. to 1400° F. in order to burn out the molds and prepare them for receiving molten metal. As an alternative procedure, the patterns can be melted out of the molds by placing them directly in a furnace at an elevated temperature up to about 1400° F. In other types of molding operations, the cores can be placed directly into cope and drag-type molds made by ceramic or plaster molding techniques, and the molds heated in a manner similar to investment molds.

The ceramic cores of the invention have the highly desirable characteristic of high strength as initially made, i.e. prior to heating the molds and casting the molten metal. This high initial strength is sufficient to resist the stresses of handling the cores and injecting pattern material around them. The strength is achieved without the necessity of prefiring the cores which has the disadvantages discussed above. It is also not necessary to impregnate the cores with colloidal silica or other refractory binders as disclosed in U.S. Pat. No. 3,686,006. This reduces the cost and simplifies quality control. In addition, no refractory residue forms on the surface of the cores, as sometimes happens when cores impregnated with a refractory binder are dried.

Ceramic cores made according to the invention have the equally desirable characteristics of being very soft after the molds incorporating the cores have been fired and filled with molten metal. The softness is such that the cores can be easily removed from the metal castings. In many cases, the cores will fall out during normal knockout of the mold material, as with a pneumatic hammer. In the event that all of the core material is not removed completely in the normal knockout operation, the residue can be easily dislodged by sand blasting or by low pressure water blasting at a pressure from about 500–1000 psi. Chemical treatment is not necessary.

Another important feature of the invention is that it is possible to formulate the cores to match the thermal expansion characteristics of the molds in which the cores are to be used. Many of the conventional bulk investment molds used in non-ferrous casting operations expand irregularly when fired to burnout the pattern material. In order to prevent the core and/or the mold from being damaged when the mold is heated, it is necessary to match the thermal expansion of the core to that of the mold. This has been very difficult to accomplish with conventional core materials. When following the practice of the present invention, the gypsum-containing refractory used to formulate the cores can be the same commercially available, gypsum-bonded investment material used to make the non-ferrous mold, whereby the thermal expansion of the core will match that of the mold. In practice it has been found possible to produce and cast successfully sizes and configurations of cores that would be beyond the capability of the same non-ferrous investment material when used to form self-cored openings in conventional bulk investment molds.

Other features and advantages and a fuller understanding of the invention will be had from the following detailed description.

BEST MODE FOR CARRYING OUT THE INVENTION

As generally described above the injection moldable core material of this invention consists essentially of comminuted refractory material as the major component, a sublimable binder, and a non-sublimable binder. Any of the refractory materials that are conventionally used for making ceramic cores, bulk investment molds and ceramic shell molds and the like can be employed in preparing the mixture. Typical refractories include fused and crystalline silica, zircon, zirconia, alumina, calcium zirconate, various alumina silicates, tricalcium phosphate, nepheline syenite, and the like.

A sublimable binder is included in the mixture so that a porous structure can be produced by subliming the binder from the core or other article molded from the mixture. The term "sublimable binder" is used to mean any material which has a sufficient high vapor pressure that it can be sublimed at a temperature below its softening point and below the softening point of the non-sublimable binder. The materials that are useful as the sublimable binder are generally characterized by the capability of being changed from a solid to a flowable state and of being re-solidified, and by a vapor pressure of at least 0.1 mm of Hg at the triple point. It has been found that materials having a vapor pressure of at least 0.1 mm of Hg at the triple point can be sublimed from the molded articles in a reasonable length of time either with only moderate heating or with no heating at all. The more preferred materials have a triple point above normal room temperature and can be sublimed at room temperature in order to avoid the danger of distorting the molded articles by excessive heating. Such materials have a vapor pressure of at least 0.1 mm of Hg at room temperature under atmospheric pressure and have a boiling point which is no higher than about 250° C., and more preferably is 200° C. or less. The preferred sublimable binders are solids at room temperature in order to avoid the necessity of refrigerating to cause solidification, and are further characterized by the capability of being melted to a flowable state upon heating and of resolidifying upon cooling.

Exemplary materials that exhibit the foregoing characteristics and are capable of serving as sublimable binders include aliphatic and substituted and unsubstituted aromatic compounds. Paradichlorobenzene is a particularly suitable compound that has a conveniently low melting point, good molding properties, low cost, and the capability of being readily sublimed. Other exemplary materials that have been found satisfactory include urethane (ethyl carbamate), acetamide, napthalene, benzoic acid, phthalic anhydride, camphor, anthracene, and parachlorobenzaldehyde. Other exemplary materials which display similar properties and are contemplated for use include 1-bromo-4-chlorobenzene, paradimethoxybenzene, paradi-butoxybenzene, and crotonic acid. The vapor pressure of materials such as paradichlorobenzene, urethane, acetamide, camphor, and naphthalene are sufficiently high that these materials can be sublimed at room temperature under normal atmospheric pressure or at pressures below atmospheric. Materials such as phthalic anhydride, benzoic acid and anthracene have a lower vapor pressure at room temperature, and while useful for the purposes of the present invention, require heating to facilitate sublimation.

A non-sublimable binder is included in the mixture to hold the molded articles intact when the sublimable binder has been removed and the articles have been soaked in water to hydrate and set the gypsum. The term "non-sublimable binder" is used to mean any material that is capable of being hardened, preferably at room temperature, to impart the necessary strength to the molded articles and has a sufficient low vapor pressure that it will not melt, sublime or evaporate at the temperatures and under the pressures employed to effect removal of the sublimable binder. The useful non-sublimable binders are further characterized by being miscible with the sublimable binder when it is in the fluid state. In addition to performing its primary function of imparting hardness and green strength to the molded articles, the non-sublimable binder or combination of such binders may be selected to impart other desired characteristics such as improving fluidity in the molding process, reducing the setup time of the mixture, etc. Exemplary materials that may be used as non-sublimable binders include various resinous and plastic materials. Examples of suitable resins are polymerized rosins, hydrogenated rosin esters, petroleum hydrocarbon resins, coumarone-indene resins, ester gums, polyterpene resins, low molecular weight styrene resins, chlorine polyphenol resins, gilsonite, abietic acid, shellac and silcone resins. Examples of suitable plastic materials include ethyl cellulose, polystyrene, polyvinyl acetate and polyvinyl alcohol.

The total binder content (subliming and non-subliming binders) may vary within a range of from about 10 to 40% by weight of the mixture, and more preferably from about 20 to 30% by weight of the mixture with the refractory constituting the remainder. The subliming binder should be at least one-half the total binder content, and usually is at least 80% of the total binder content. The amount of the subliming binder used in preparation of the mixture may vary widely over a range of about 10 to 35% by weight of the mixture with a more preferred range being from about 18 to 25% by weight of the mixture.

The amount of the non-subliming binder may vary from about 0.8 to 11% by weight of the mixture with a more preferred range being from about 2 to 5.5% by weight of the mixture.

The technology of formulating mixtures of refractories with a non-subliming and a subliming binder is well disclosed in U.S. Pat. Nos. 3,686,006, 3,769,044, 3,859,405, and the disclosures of those patents are incorporated by reference.

In accordance with the present invention, the refractory content of the mixture is compounded to include partially dehydrated gypsum, preferably in the alpha form. The preferred material is calcium sulfate hemihydrate ($CaSO_4\frac{1}{2}H_2O$), and more specifically is alpha calcium sulfate hemihydrate. The gypsum content may range from about 20 to 50% by weight based on the total weight of refractory material in the mixture.

The comminuted refractory material and binders are mixed together by any suitable procedure. For example, the binders may be heated and blended together in a suitable mixture and the comminuted refractory material added to the blend until the mixture is of the desired consistency for the molding operation. If desired, the refractory material may be warmed prior to adding it to the blended binders. The resulting mixture may be molded while hot or it may be solidified and subsequently melted for the molding operation. Refractory articles such as cores, can be quickly and inexpensively formed by injection molding using conventional plastic injection molding machines. For purposes of injection molding, the mixture is cooled and granulated, as by stirring the melt as it cools to solidification, and the granules are charged into the injection molding machine in the conventional manner. The refractory mixture also can be employed in any of the other well known techniques for forming cores and the like. Such alternate techniques include casting or pouring, transfer molding, extruding, etc. After the cores or other articles have been injection molded or otherwise formed, the subliming binder is sublimated from the molded shape to provide a porous structure. When the subliming binder has been removed, the molded shapes are soaked in water to saturate the pores. The molded articles are then removed from the water and the water in the pores is allowed to hydrate the gypsum and cause it to set.

When the gypsum content has been hydrated and set, the cores are sufficiently strong that they can be incorporated into patterns in the usual manner. This can be accomplished by placing the cores in a pattern injection die and injecting molten pattern materials such as wax around them. Alternatively, the cores can be inserted into suitable openings in the patterns. The molds are then formed around the patterns and the cores in the usual manner. As explained previously, these can be either bulk investment molds or ceramic shell type molds.

The invention is illustrated by the following examples.

EXAMPLE 1

A core batch was prepared of the following composition:

600 grams paradichlorobenzene
57.1 grams ethyl cellulose (20 cps grade)

65.6 grams shellac
450 grams alpha gypsum
450 grams silica, quartz (minus 200 mesh)
600 grams wollastonite (minus 325 mesh)
2 grams oil soluble orange color It will be noted that the alpha gypsum constituted 30% by weight of the refractory portion of the mixture. The paradichlorobenzene functioned as the subliming binder and the ethyl celluose and shellac as the non-subliming binders.

The core mixture was prepared by melting and heating the paradichlorobenzene to 250° F. The ethyl cellulose and shellac were dissolved in it, and then the refractory materials together with the orange coloring (used for identification purposes only) were added and stirred into the mixture. This operation was carried out using a planetary-type mixer having a wire whip-type agitator. The core batch was then poured into an aluminum pan and agitated occasionally with a spatula as it solidified in order to granulate it.

Cores were made for a metal marking tool, a commercial investment casting. The cores had a flat rectangular shape with a semi-circular groove in the face, and were used to form a slot in the handle of the tool. The slot served to accommodate and hold metal stamps inserted into it.

The core material in granulated form was fed into the hopper of the standard plastic injection molding machine. This machine was of the plunger-type with horizontal injection and vertical mold opening and closing. Injection of the core material was along the parting line of the mold. The cores were injected under the following conditions:

Cylinder temperatures 200° F.
Nozzle temperature 200° F.
Injection pressure 1000 psi.

After molding the subliming binder was sublimated at room temperature by subjecting the cores to a vacuum of approximately 27 inches of mercury below atmospheric pressure until there was no further loss in weight. The cores were then placed in warm water at a temperature of approximately 125° F. and where subjected to vacuum for three minutes to saturate the pores with water. The vacuum was released and the cores removed and placed on a screen to drain and allow water to hydrate the gypsum.

Wax patterns for the intended casting were injected. Because of simple pattern configuration, the cores were inserted directly into appropriate openings in the patterns while they were still warm.

The patterns containing the cores were attached to conventional center sprue members and ceramic shell molds were formed around the assembly in the usual manner. The slurry used to make the shell molds comprised a fused silica powder suspended in a colloidal silica binder and small amounts of anti-foam and wetting agents. The shells were built up around the pattern assemblies by the repeated steps of dipping, draining, stuccoing and drying.

After drying, the molds were dewaxed by placing them in a steam autoclave operating at 90 psig for 10 minutes. The molds were then fired at 1350° F. for one hour and an aluminum alloy at 1300° F. was poured into the molds.

After cooling, the ceramic shell molds were removed from the castings manually using a hammer. By the time the outer mold had been knocked off, it was found that the preformed cores had dropped out of the castings. The cores functioned in the manner desired and the passageways that they formed in the castings were satisfactory in all respects.

EXAMPLE II

The cores made in accordance with Example 1 are very soft and after casting of the molten metal and can be easily removed from most cast shapes. If for any reason it is desired to have a core which is even softer after casting, this can be obtained easily by substituting zircon flour for the wollastonite of Example I, and producing and processing the cores in the identical manner. Cores identical to those of Example 1 except for the substitution of minus 325 mesh zircon flour for wollastonite were produced and found satisfactory, as were the castings made with the cores.

EXAMPLE III

A major advantage of the composition and process of the invention is that the cores can be formulated to closely match the highly irregular thermal expansion characteristics of the commercial non-ferrous investment material. One way of accomplishing this is to formulate the core from the same investment material used to make the mold in which the cores will be used. This technique is illustrated by preparation of a core batch of the following composition:

600 grams paradichlorobenzene
57.1 grams ethyl cellulose (20 cps grade)
65.6 grams shellac
1700 grams SI-401 Investment material SI-401 Investment material is a commercial non-ferrous investment manufactured by Pre-Vest Inc., Cleveland, Ohio, and contains 30% alpha gypsum as the binder.

Cores were made from the above composition in the same manner as in Example 1. The finished cores were placed into a wax injection die and molten pattern material was injected around them to form patterns for the hammer of a hand gun. The patterns were mounted on a wax-coated cardboard drum and this assembly was placed into a perforated metal flask. The flask was filled with investment material using the same SI-401 investment used to formulate this ceramic core blend, the investment material being mixed with water according to the manufacturer's instructions. After the investment mold had set, the mold was dewaxed by placing it into a steam autoclave at 5 psig. The mold was then fired to a temperature in the range of from 1300° to 1350° F. to burn out the pattern material. Following this, the mold was cooled to about 600° F. preparatory to receiving the molten metal. An aluminum alloy at 1300° F. was cast into the mold in accordance with the procedure described in U.S. Pat. No. 3,705,615.

After casting, the mold material was knocked from the castings in a conventional manner using a pneumatic knockout hammer. During this operation, the preformed cores were completely removed from all of the castings. The resulting castings were completely satisfactory, including the cored openings.

In another similar test, the same composition and methods were used to make cores for a copper alloy casting. The core had a flat, twisted shape and formed a longitudinal slot in a guide rod casting. The pattern wax was injected around the cores, and the patterns were assembled and invested in the manner described above. The mold was dewaxed and fired as previously described and then cooled to 900° F. A phosphor gear bronze alloy at 1950° F. was cast into the mold. After casting, the investment mold material was removed by a pneumatic hammer. The preformed cores were not completely removed from all of the castings in this operation, but the remaining core material was easily removed in a water blasting cabinet operating on a pressure of 900 psig.

In yet another test, the same material and methods were used to inject a cylindrical core ¼ inch in diameter which was then used to form a 1⅜ inch deep blind hole in a prototype casting of a slide bar block. The pattern was machined from the composition disclosed in U.S. Pat. No. 4,064,083 (Example 1). The core was inserted into a hole that had been drilled in the pattern.

The pattern containing the core was assembled and processed as described above in connection with the production of the gun hammer castings. Because of the requirements of the pattern itself, a different commercial investment material identified as PV-408, also made by Pre-Vest Inc., of Cleveland, Ohio was used. This investment contains 35% alpha gypsum as a binder. After the mold had been invested, it was placed in an autoclave at 5 psig to remove the pattern. It was then fired to 1300° F. for burnout. The mold was cooled to 400° F. and was cast with an aluminum alloy at 1300° F.

After casting, the investment mold was knocked out with a pneumatic hammer. The preformed core fell out in the same operation. The resulting casting including the cored hole was completely satisfactory.

Many modifications and variations of the invention will be apparent to those skilled in the art in view of the foregoing detailed description. Therefore, it is to be understood that, within the scope of the appended claims, the invention can be practiced otherwise than as specifically disclosed.

I claim:

1. In a process of making molded refractory articles from a mixture containing comminuted refractory material and a sublimable binder that is sublimated after molding to provide a porous structure, the improvement characterized by the steps of compounding said mixture to include partially dehydrated gypsum as part of the refractory material, soaking the molded article in water after the sublimable binder has been sublimated, and allowing the water in the pores of the molded article to hydrate the gypsum and cause it to set.

2. The improvement as claimed in claim 1 characterized in that the gypsum is calcium sulfate hemihydrate.

3. The improvement as claimed in claim 1 or 2 wherein the gypsum is in the alpha form and is present in an amount of from 20 to 50% by weight based on the weight of refractory material.

4. A process of making molded refractory articles comprising the steps of:

(a) preparing a mixture of refractory material and sublimable and non-sublimable binders, said refractory material including partially dehydrated gypsum in the alpha form;
(b) molding said mixture into a desired shape;
(c) sublimating the sublimable binder from the molded shape to provide a porous structure;
(d) soaking the molded shape in water to saturate its pores;
(e) removing the molded shape from the water,
(f) allowing the water in the pores to hydrate the gypsum and cause it to set.

5. The process as claimed in claim 4 wherein the gypsum is calcium sulfate hemihydrate.

6. The process as claimed in claim 4 or 5 wherein the gypsum is present in an amount of from 20 to 50% by weight based on the weight of refractory material.

* * * * *